US009127841B2

(12) United States Patent
Bourgois et al.

(10) Patent No.: US 9,127,841 B2
(45) Date of Patent: Sep. 8, 2015

(54) TURBOMACHINE COMBUSTION CHAMBER COMPRISING IMPROVED MEANS OF AIR SUPPLY

(75) Inventors: Sebastien Alain Christophe Bourgois, Saint Germain les Corbeil (FR); Romain Nicolas Lunel, Montereau sur le Jard (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 820 days.

(21) Appl. No.: 13/255,772

(22) PCT Filed: Mar. 15, 2010

(86) PCT No.: PCT/EP2010/053249

§ 371 (c)(1),
(2), (4) Date: Oct. 19, 2011

(87) PCT Pub. No.: WO2010/105999

PCT Pub. Date: Sep. 23, 2010

(65) Prior Publication Data

US 2012/0055164 A1 Mar. 8, 2012

(30) Foreign Application Priority Data

Mar. 17, 2009 (FR) ..... 09 51673

(51) Int. Cl.
*F02C 1/00* (2006.01)
*F23R 3/10* (2006.01)

(52) U.S. Cl.
CPC ..... *F23R 3/10* (2013.01)

(58) Field of Classification Search
CPC ..... F02C 5/02; F23R 3/04; F23R 3/10; F23R 3/26; F23R 3/34; F23R 3/42; F23R 3/44; F23R 3/46; F23R 3/50; F23R 3/60
USPC ..... 60/752–760, 746
See application file for complete search history.

(56) References Cited

U.S. PATENT DOCUMENTS 4,689,961 A 9/1987 Stratton
5,142,858 A 9/1992 Ciokajlo et al.

(Continued)

FOREIGN PATENT DOCUMENTS

EP 0 153 842 A1 9/1985
EP 0 724 119 A2 7/1996

(Continued)

OTHER PUBLICATIONS

International Search Report issued Aug. 13, 2010, in PCT/EP2010/053249.

(Continued)

*Primary Examiner* — Phutthiwat Wongwian
*Assistant Examiner* — Arun Goyal
(74) *Attorney, Agent, or Firm* — Oblon, McClelland, Maier & Neustadt, L.L.P.

(57) ABSTRACT

Annular combustion chamber (10) to be fitted on a turbomachine and comprising a chamber end wall (22), a plurality of air and fuel injection systems (32) circumferentially distributed around an axis (34) of the combustion chamber (10) and mounted on said chamber end wall (22), and, an air manifold (100) associated with each injection system (32), comprising at least one wall (96, 98) mounted on the chamber end wall (22) and projecting in the upstream direction to form an obstacle to a circumferential airflow around the axis (34) of the combustion chamber (10), and an air inlet opening (88) formed at the upstream end of the air manifold (100) and opening radially outwards from an axis (44) of said injection system.

6 Claims, 5 Drawing Sheets

(56) References Cited

U.S. PATENT DOCUMENTS

| | | | | |
|---|---|---|---|---|
| 5,623,827 | A | 4/1997 | Monty | |
| 6,148,600 | A | 11/2000 | Farmer et al. | |
| 6,779,268 | B1 | 8/2004 | Farmer | |
| 7,222,488 | B2 * | 5/2007 | Farmer et al. | 60/747 |
| 2009/0019856 | A1 | 1/2009 | Commaret et al. | |
| 2011/0271678 | A1 | 11/2011 | Bourgois et al. | |
| 2013/0160452 | A1 | 6/2013 | Bourgois et al. | |

FOREIGN PATENT DOCUMENTS

| | | | |
|---|---|---|---|
| EP | 0 724 119 | A3 | 7/1996 |
| EP | 1 477 741 | A1 | 11/2004 |
| EP | 2 012 061 | A1 | 1/2009 |
| FR | 2 909 163 | A1 | 5/2008 |
| FR | 2 910 597 | A1 | 6/2008 |

OTHER PUBLICATIONS

French Preliminary Search Report issued Oct. 29, 2009, in French Patent Application No. FR0951673 with English translation of category of cited documents.

U.S. Appl. No. 14/609,533, filed Jan. 30, 2015, Berton, et al.

* cited by examiner

TURBOMACHINE COMBUSTION CHAMBER COMPRISING IMPROVED MEANS OF AIR SUPPLY

TECHNICAL FIELD

This invention relates to an annular combustion chamber for a turbomachine, for example such as aircraft turbojet or turboprop.

STATE OF PRIOR ART

Turbomachines generally comprise an annular combustion chamber mounted downstream from a compressor.

The combustion chamber is delimited on the upstream side by an annular end wall fitted with injection systems uniformly distributed around the turbomachine axis and that will be used to inject an air and fuel mix into the combustion chamber.

The compressor outlet opens up into an enclosure in which the combustion chamber is housed. The compressor may be an axial compressor and comprise an outlet approximately in line with the combustion chamber injection systems, or it may be centrifugal and comprise an annular guide vane assembly outlet opening up into a region radially outward in the combustion chamber enclosure.

Combustion chamber injection systems comprise peripheral drillings through which air can enter from the compressor, and means of centring and guiding fuel injector heads.

Injection systems are designed to optimise performances of the combustion chamber and thus reduce its fuel consumption and pollutant emissions.

In general, performances of injection systems are better if the pressure loss inside these injection systems is high, and if the air supply to these systems is uniform around their corresponding axes. Therefore it is desirable to minimise the pressure loss on the upstream side of these injection systems so as to limit the global pressure losses affecting the airflow supplying the combustion chamber, while allowing a high pressure loss inside injection systems.

Since the compressor outlet is at a distance axially from injection systems, the airflow from the compressor usually arrives at the injection systems after suffering a high pressure loss and being non-uniformly distributed around each injection system.

These problems are particularly sensitive in the case of centrifugal compressors for which the outlet is not in line with the combustion chamber injection systems, and is arranged radially outwards from these injection systems.

PRESENTATION OF THE INVENTION

The main purpose of the invention is to provide a simple, economic and efficient solution to these problems to overcome the above mentioned disadvantages.

In particular, its purpose is to reduce pressure losses in the airflow from a compressor in a turbomachine, between the outlet from this compressor and the inlet to injection systems of the turbomachine combustion chamber, so as particularly to enable an increase in the pressure loss inside these injection systems without considerably increasing the global pressure loss of the airflow supplying the combustion chamber.

Another purpose of this invention is to make the air supply to combustion chamber injection systems more uniform.

The invention discloses a means of achieving this by providing an annular combustion chamber to be fitted on a turbomachine, comprising a chamber end wall arranged at the upstream end of the combustion chamber, and a plurality of air and fuel injection systems circumferentially distributed around an axis of the combustion chamber and mounted on the chamber end wall. The annular combustion chamber also comprises an air manifold associated with each injection system comprising at least one wall mounted on the chamber end wall and projecting in the upstream direction to form an obstacle to a circumferential airflow around the axis of the combustion chamber, and an air inlet opening formed at the upstream end of the above-mentioned air manifold. According to the invention, the air inlet opening of each air manifold is open radially outwards from an axis of the corresponding injection system.

Air manifolds according to the invention can directly optimise an airflow from a region radially outward from the respective axes of the injection systems and supplying these injection systems, around each of these systems.

The air manifolds can thus reduce the pressure loss applied to this airflow on the upstream side of these injection systems, and make the air supply for these systems more uniform.

The result is an improvement in the general performances of the combustion chamber, and more particularly an increase in its efficiency and a reduction in emissions of polluting substances by the combustion chamber.

An airflow from a region radially outwards from the respective axes of the combustion chamber injection systems occurs particularly in turbomachines with a centrifugal compressor. Therefore, the invention is particularly advantageous when it is applied to this type of turbomachine.

Preferably, when the air inlet opening of each manifold is seen in projection in a transverse plane perpendicular to a tangential plane passing through the centre line of the corresponding injection system, the part of said opening located radially outwards from the above-mentioned tangential plane has a larger opening area than the part of said opening that is located radially inwards from this tangential plane.

This configuration can further optimise the air inlet from a region radially outward from the respective axes of combustion chamber injection systems.

Each air manifold preferably comprises two walls mounted on the chamber end wall, said walls projecting towards the upstream direction and being arranged on each side of the corresponding injection system so as to form an obstacle to a circumferential airflow around the axis of the combustion chamber.

In a first embodiment of the invention, the two walls of each air manifold are concave facing said air manifold and are connected to each other by two opposite ends of each of these walls, such that each air manifold is globally tubular in shape and comprises an upstream end forming said air inlet opening.

This makes the air distribution around each injection system more uniform.

Advantageously, the upstream end of each air manifold is shaped such that a radially inward part of this upstream end is offset in the upstream direction relative to a radially outward part of said upstream end of the air manifold.

This radially inward part of the upstream end of each air manifold can thus form an airflow guide scoop for air originating from a region radially outward from the injection systems.

In a second embodiment of the invention, the combustion chamber comprises a annular chamber end wall shielding arranged on the upstream side of the chamber end wall and to which the walls of each air manifold are connected in an almost airtight manner on each side of a corresponding orifice formed in the shielding, said orifice forming said air inlet opening of the air manifold.

The above-mentioned walls can delimit compartments forming air manifolds between the chamber end wall and the shielding around each injection system.

Preferably, said walls of each air manifold extend radially and each of these walls forms part of two consecutive air manifolds around the axis of the combustion chamber.

In particular, this configuration has the advantage of minimising the total number of air manifold walls.

The air inlet opening of each air manifold is preferably tapered, opening up radially outwards. This means that said air inlet opening has an outward edge that is larger than its inward edge.

As a variant, or as a complementary feature, the annular shielding may comprise a radially inward annular part and a radially outward annular part between which said air inlet openings are formed, the radially inward annular part being offset from the radially outward annular part in the upstream direction.

In this case, the shape of the shielding orients the air inlet opening radially outwards.

In general, each injection system comprises a centring and guide bushing for the injector head, each air manifold preferably comprises at least one part that extends in the upstream direction beyond an upstream end of said bushing of the corresponding injection system.

The capabilities of the air manifolds to direct the air supplying the injection systems fitted on the combustion chamber are thus optimised.

The invention also relates to a turbomachine comprising a combustion chamber of the type described above.

BRIEF DESCRIPTION OF THE DRAWINGS

The invention will be better understood and other details, advantages and characteristics of the invention will become clear after reading the following description given as a non-limitative example with reference to the appended drawings in which.

DETAILED PRESENTATION OF PREFERRED EMBODIMENTS

Figure 1:
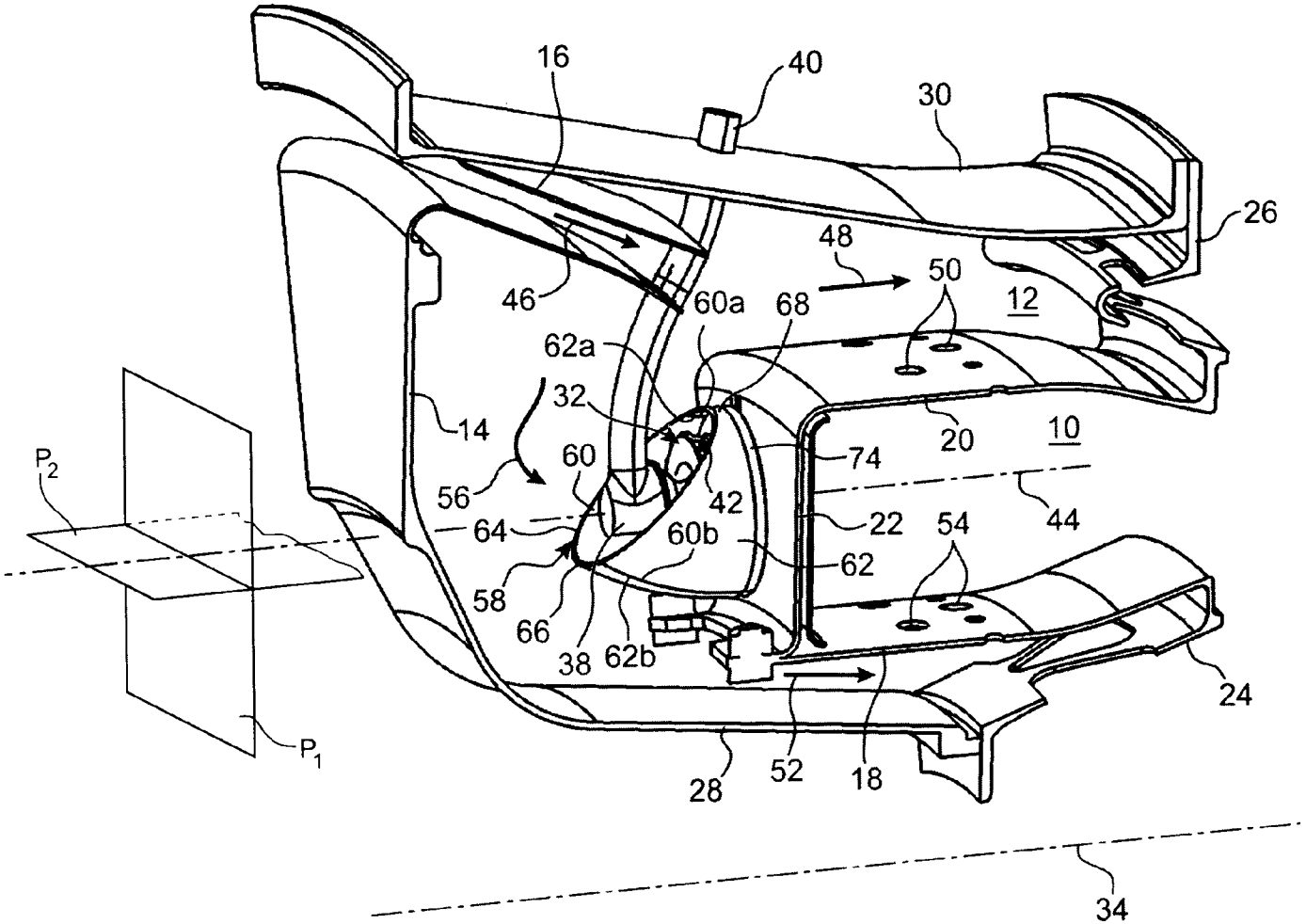
FIG. 1 is a partial diagrammatic perspective view of a turbomachine according to a first embodiment of the invention.
Figure 2:
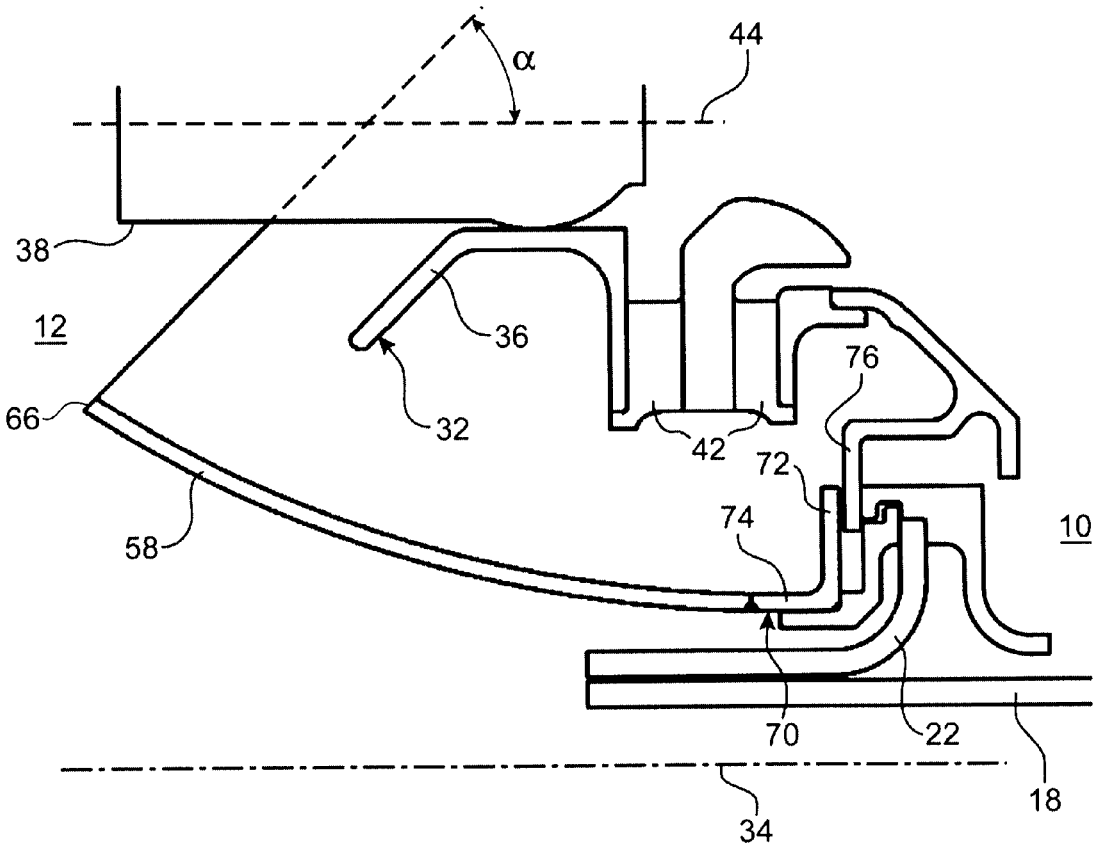
FIG. 2 is a partial diagrammatic view of an axial section of the turbomachine in FIG. 1, at a larger scale.

FIGS. 1 and 2 show a combustion chamber 10 of a turbomachine according to a first embodiment of the invention, and the immediate environment around this combustion chamber.

The combustion chamber 10 is housed in an enclosure 12 formed on the downstream side of a centrifugal compressor of the turbomachine in a known manner, the outlet of the compressor being connected to a radial diffuser 14 itself connected at the outlet to a flow guide vane assembly 16 that opens up into a radially outward region of the enclosure 12.

The combustion chamber 10 is delimited by two approximately cylindrical coaxial walls 18 and 20, internal and external respectively, and by an annular chamber end wall 22 that extends approximately radially at the upstream end of the chamber 10 and that is connected through its radial ends to the two walls 18 and 20.

The internal wall 18 and external wall 20 of the combustion chamber 10 are fixed on the downstream side by the internal shell 24 and external shell 26 onto an approximately cylindrical internal wall 28 connected to the diffuser 14 and to an external casing 30, so as to delimit the enclosure 12.

Injection systems 32 that are uniformly distributed around the axis 34 of the combustion chamber are installed in the chamber end wall 22. Each injection system 32 comprises particularly a centring and guide bushing 36 for a head 38 of a fuel injector 40, and air inlet orifices 42 arranged around a centre line 44 of the injection system.

The bushing 36 of each injection system 32 is used to align the corresponding injector head 38 on the axis 44 of the injection system. Furthermore, injection systems 32 are configured to enable a certain radial and axial clearance of the injector heads 38 to take account of any differential expansions that could cause relative displacements between the injectors 40 and the combustion chamber 10.

During operation, an airflow 46 from the centrifugal compressor is injected through the guide vane assembly 16 into the enclosure 12.

The airflow 46 that arrives in a radially external region of the enclosure 12 is globally separated into three parts in this enclosure 12.

A first part 48 of the airflow flows in the downstream direction along the external wall 20 of the combustion chamber 10 and partially penetrates into the combustion chamber 10 through orifices 50 formed in its external wall 20.

A second part 52 of the airflow flows in the downstream direction along the internal wall 18 of the combustion chamber 10 and partially penetrates into the combustion chamber 10 through orifices 54 formed in its internal wall 18.

Finally, a third part 56 of the airflow supplies injection systems 32 of the combustion chamber 10.

The combustion chamber 10 according to the first embodiment of the invention is equipped with a plurality of air manifolds 58 (one of which can be seen in FIGS. 1 and 2).

Each air manifold 58 comprises two similar walls 60 and 62 (FIG. 1) that are curved around the corresponding injection system 32 and are concave facing this injection system 32, and are mounted on the chamber end wall 22 at their corresponding downstream ends.

In the embodiment shown, each of the two walls 60 and 62 of each air manifold 58 comprises two opposite ends 60*a*, 60*b* and 62*a*, 62*b* respectively through which these two walls 60 and 62 are connected to each other, such that each air manifold 58 has a globally tubular shape.

The air manifolds 58 each have an upstream end delimiting an air inlet opening 64 through which air 56 from the guide vane assembly 16 can penetrate to reach the air inlet orifices 42 of the injection systems 32.

The two walls 60, 62 of each air manifold 58 are truncated on the upstream side on an inclined plane relative to the axis 44 of the corresponding injection system such that the air inlet opening 64 of each air manifold 58 is open facing the outlet from the guide vane assembly 16, in other words is radially open outwards from the axis 44 of the above-mentioned injection system, to facilitate entry of air from this guide vane assembly 16 into the air manifolds 58.

The upstream edge of each air manifold 58 thus comprises a radially internal part 66 that is offset in the upstream direction relative to a radial external part 68 of this upstream edge.

Figure 1A:
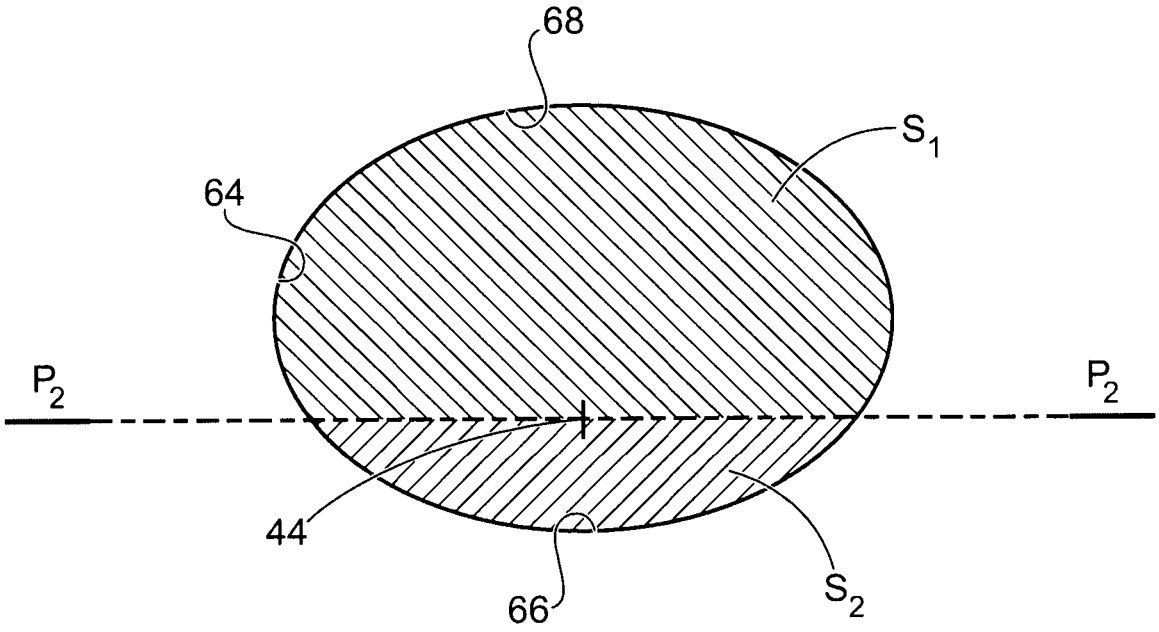
FIG. 1*a* is a partial diagrammatic view of the turbomachine in FIG. 1, projected onto plane P1 in FIG. 1.

As can be seen in FIG. 1*a*, when each air inlet opening 64 is seen in projection in the transverse plane P1 in FIG. 1, which is perpendicular to the tangential plane P2 passing through the axis 44 of the injection system 32, the part of the opening 64 that is radially outward from the above-mentioned tangential plane P2 has a opening area $S_1$ larger than the opening area $S_2$ of the part of said opening 64 that is radially inward from the tangential plane P2.

As can be seen in FIG. 2, the radially internal part 66 of the upstream edge of each air manifold 58 extends in the upstream direction beyond the upstream end of the centring and guide bushing 36 of the corresponding injector head 38. This radially internal part 66 thus forms a particularly efficient scoop to guide the air stream from the guide vane assembly 16.

The inclination of the air inlet opening 64 of each air manifold 58 relative to the axis 44 of the corresponding injection system is defined particularly so that it does not hinder axial and radial displacements of the corresponding injector head 38 in operation and also during assembly and disassembly of the injector 40.

Thus, the angle $\alpha$ formed between the air inlet opening 64 and the axis 44 (FIG. 2) is typically between approximately 40 degrees and 80 degrees.

In the embodiment shown in FIGS. 1 and 2, the two walls 60 and 62 of each air manifold 58 are fixed at their downstream ends onto an annular part 70, sometimes called the stop dish, which is fixed to the chamber end wall 22 and which comprises an annular end plate 72 extending radially around the axis 44 of the corresponding injection system 32, and an annular rim 74 that extends parallel to the axis 44 from the inner periphery of the annular end plate 72 of the stop dish 70.

The attachment of the walls 60 and 62 to the stop dish 70 may for example be made by welding, such that the walls 60 and 62 are an extension of the annular rim 74 of the stop dish 70.

In a manner known in itself, the stop dish 70 is capable of axially blocking the injection system 32 by cooperation of the annular end plate 72 of the stop dish with an annular end plate 76 fixed to the injection system 32 and installed free to slide radially in an annular groove formed between the chamber end wall 32 and the end plate 72 of the stop dish 70.

In general, air manifolds 58 are capable of directing air from the guide vane assembly 16 around each injection system 32, which reduces pressure losses on the upstream side of these injection systems and improves uniformity of the air supply to these injection systems. To achieve this, the air manifolds have a remarkable property in that each forms an obstacle to the circumferential airflow between two adjacent injection systems along the chamber end wall 22.

As a variant, each manifold may also be truncated by a tangential plane passing through the corresponding injector head 38. When the air guidance level procured by such an air manifold is sufficiently high, this configuration can give an advantageous saving of the mass.

Furthermore, each air manifold 58 may be made in a single piece without going outside the scope of the invention.

Figure 3:
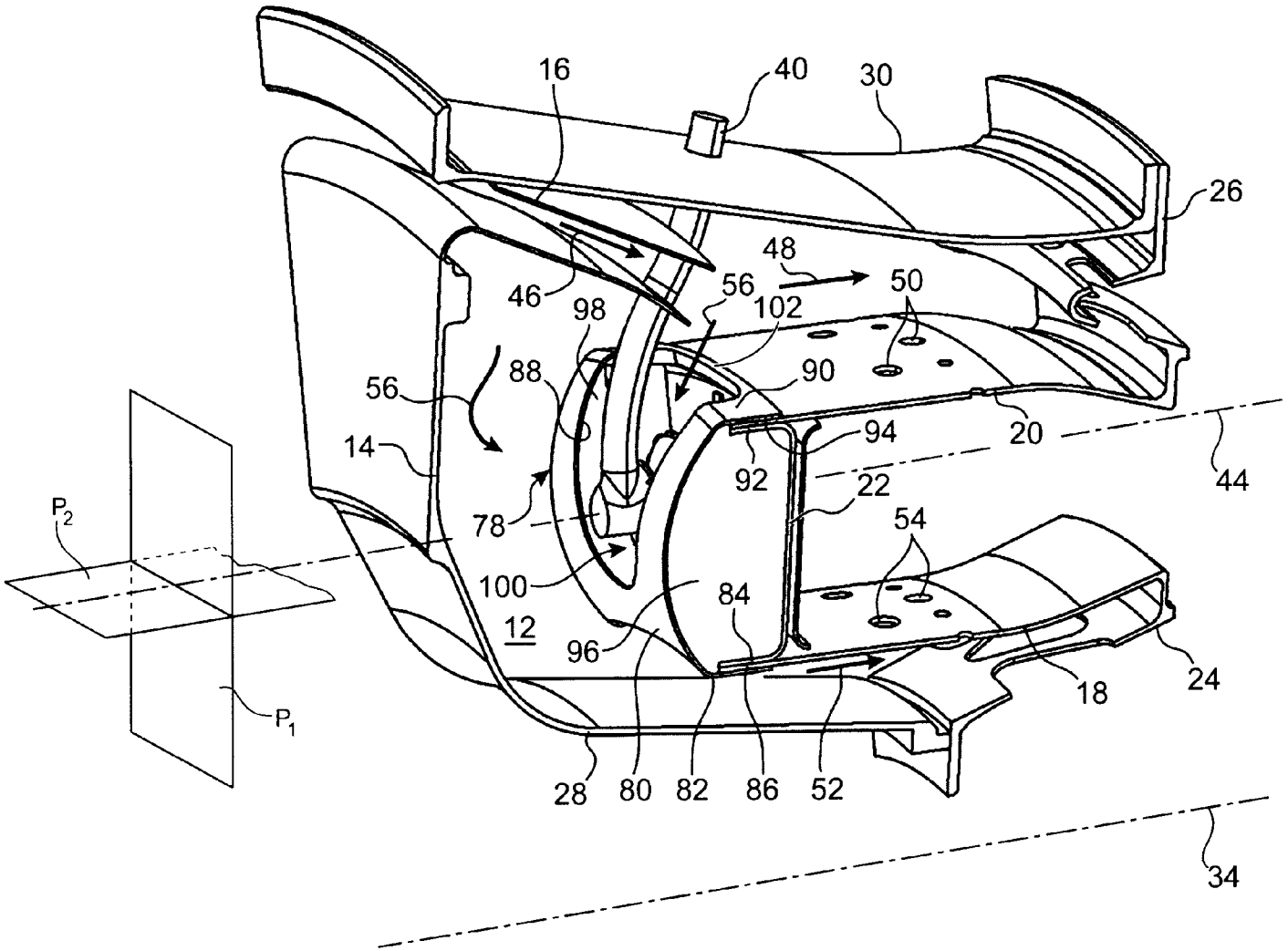
FIG. 3 is a view similar to FIG. 1, of a turbomachine according to a second embodiment of the invention.

FIG. 3 shows a second embodiment of the invention in which the end wall 22 of the combustion chamber 10 is equipped with an annular protective shielding 78 arranged upstream from this chamber end wall 22.

The shielding 78 comprises a continuous radially internal annular part 80 that has an edge 82 fixed jointly onto an inner rim 84 of the chamber end wall 22 and an upstream edge 86 of the inner wall 18 of the combustion chamber 10.

The shielding 78 also comprises air inlet openings 88 formed facing each injection system 32 and that extend outwards as far as the radially external end of the shielding 78 such that the radially external edge 90 of this shielding is split at each of these openings 88. This external edge 90 of the shielding is fixed jointly onto an outer rim 92 of the chamber end wall 22 and onto an upstream edge 94 of the outer wall 20 of the combustion chamber 10.

Figure 3A:
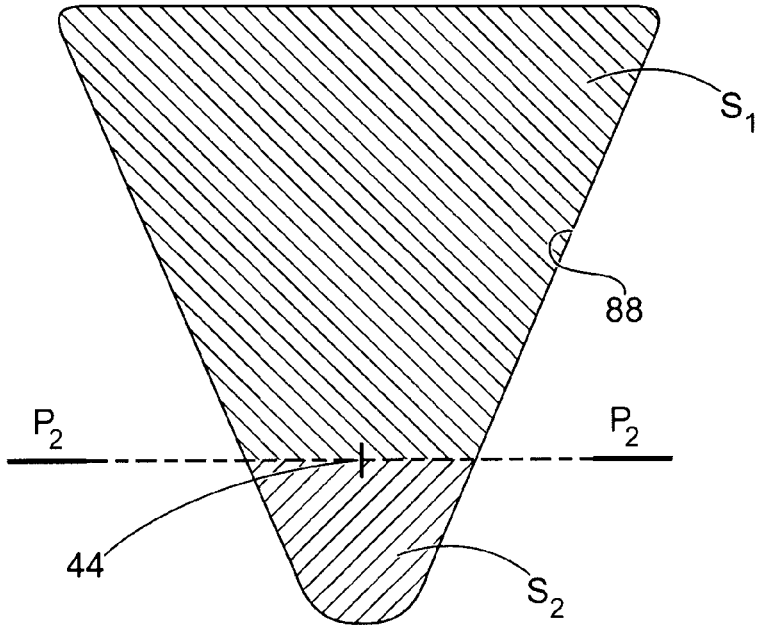
FIG. 3*a* is a partial diagrammatic view of the turbomachine in FIG. 3, projected onto plane P1 in FIG. 3.

As shown in FIG. 3*a*, when each air inlet opening 88 is seen in projection in the transverse plane P1 perpendicular to the tangential plane P2 passing through the axis 44 of the injection system 32, the opening area $S_1$ of the part of the opening 88 located radially outwards from the above-mentioned tangential plane P2 is larger than the opening area $S_2$ of the part of the opening 88 located radially inwards from the tangential plane P2.

The air inlet openings 88 are thus opening radially outwards relative to the axis 44 of each injection system 32, which facilitates the airflow 56 from the guide vane assembly 16 supplying the injection systems 32.

In the example shown in FIG. 3, the air inlet openings 88 of the shielding 78 are tapered.

Figure 4:
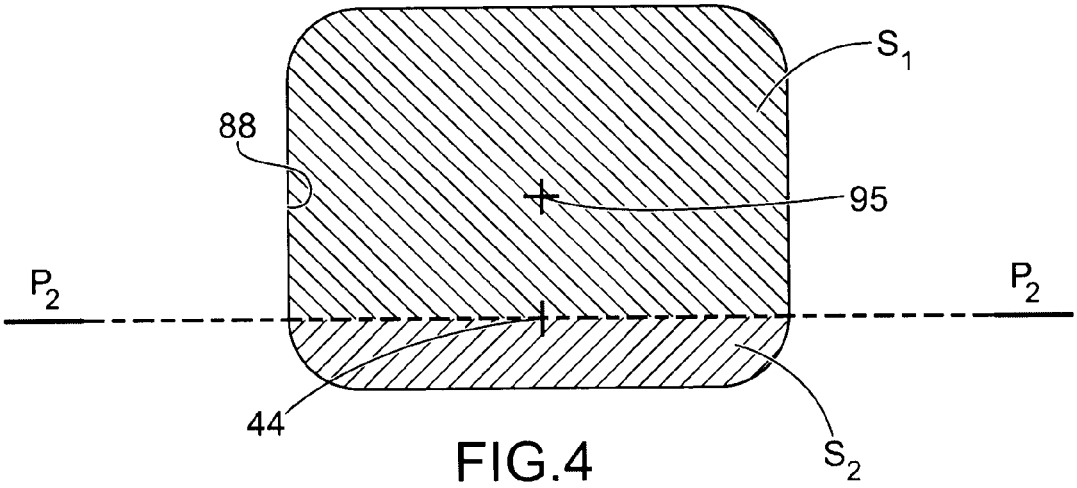
FIG. 4 is a view similar to FIG. 3*a*, showing a variant embodiment of the turbomachine in FIG. 3.

As a variant, each air inlet opening 88 may be centred on an axis 95 contained in a plane passing through the axis 44 of the corresponding injection system and through the axis 34 of the combustion chamber, said axis 95 being radially offset outwards relative to said axis 44 of the injection system or being inclined relative to this axis 44. FIG. 4 shows an opening 88 of this type seen in projection in the above-mentioned transverse plane P1.

In all cases, air inlet openings 88 satisfy the above property relative to the opening areas $S_1$ and $S_2$ defined on each side of the tangential plane P2.

Note also that each air inlet opening 88 extends between a radially outer part 102 of the shielding and the above-mentioned radially inner annular part 80 of this shielding 78, this radially inner part 80 being offset in the upstream direction from the above-mentioned radially external part 102.

Furthermore, in the second embodiment of the invention, the end wall 22 of the combustion chamber 10 is fitted with pairs of manifold walls 96 and 98 arranged on each side of each injection system 32 and the corresponding opening 88, as shown in FIG. 3. These manifold walls 96, 98 are plane and project in the upstream direction from the chamber end wall 22 and extend in respective planes passing through the axis 34 of the combustion chamber.

Each manifold wall 96, 98 is connected to be practically sealed to the chamber end wall 22 and to the shielding 78, for example by welding or by bolting.

In this way, each pair of walls 96 and 98 delimits a compartment between the chamber end wall 22 and the shielding 78. This compartment forms an air manifold 100 that is functionally similar to the air manifold 58 in the first embodiment of the invention. In particular, this air manifold 100 can direct air around each injection system 32, by preventing any circumferential airflow between two adjacent injection systems along the chamber end wall 22.

As a variant, each of the walls 96 and 98 may be curved around the corresponding injection system 32, in other words being concave facing the injection system 32.

As another variant, it is possible to have only a single air manifold wall between two adjacent injection systems 32, such that each manifold wall participates in the formation of two adjacent air manifolds.

The invention claimed is:

1. An annular combustion chamber comprising:

an outer wall and an inner wall, the combustion chamber defined between said outer wall and said inner wall, a chamber end wall arranged at an upstream end of the combustion chamber and attached to said outer wall and said inner wall, an annular chamber end wall shielding arranged on an upstream side of the chamber end wall and attached to said outer wall and said inner wall, and a plurality of air and fuel injection systems circumferentially distributed around an axis of the combustion chamber and mounted on said chamber end wall, said combustion chamber also comprising an air manifold associated with each injection system, said air manifold comprising two manifold walls mounted on and connected to the chamber end wall so as to be substantially sealed to said chamber end wall and projecting in an upstream direction on each side of the injection system such that said two manifold walls form an obstacle to a circumferential airflow around the axis of the combustion chamber, said two manifold walls being connected in an almost airtight manner to said annular chamber end wall shielding on each side of a corresponding orifice formed in said annular chamber end wall shielding, said orifice forming an air inlet opening formed at an upstream end of said air manifold and opening radially outwards relative to an axis of said injection system, wherein said two manifold walls of each air manifold extend radially relative to the axis of the combustion chamber and each of these manifold walls forms part of two consecutive air manifolds.

2. The annular combustion chamber according to claim 1, wherein when said air inlet opening of each air manifold is seen in projection in a transverse plane perpendicular to a tangential plane passing through said centre line of the corresponding injection system, the part of said opening located radially outwards from said tangential plane has a larger opening area than the part of said opening that is located radially inwards from said tangential plane.

3. The annular combustion chamber according to claim 1, wherein said air inlet opening of each air manifold is tapered, opening up radially outwards.

4. The annular combustion chamber according to claim 1, wherein said annular shielding comprises a radially inward annular part and a radially outward annular part between which said air inlet openings are formed, said radially inward annular part being offset from the radially outward annular part in the upstream direction.

5. The annular combustion chamber according to claim 1, wherein each injection system comprises a centring and guide bushing for the injector head, and each air manifold comprises at least one part that extends in the upstream direction beyond an upstream end of said bushing of the corresponding injection system.

6. A turbomachine, comprising a combustion chamber according to claim 1.

* * * * *

UNITED STATES PATENT AND TRADEMARK OFFICE

CERTIFICATE OF CORRECTION

PATENT NO. : 9,127,841 B2
APPLICATION NO. : 13/255772
DATED : September 8, 2015
INVENTOR(S) : Sebastien A. Bourgois et al.

It is certified that error appears in the above-identified patent and that said Letters Patent is hereby corrected as shown below:

IN THE SPECIFICATION

In column 5, line 46, change "manifolds have" to --manifolds 58 have--.

Signed and Sealed this
Twenty-second Day of March, 2016

Michelle K. Lee

Michelle K. Lee
*Director of the United States Patent and Trademark Office*